US008905263B2

(12) United States Patent
Becherer et al.

(10) Patent No.: US 8,905,263 B2
(45) Date of Patent: Dec. 9, 2014

(54) DISPENSER

(75) Inventors: Thorsten Becherer, Köln (DE); Annie Sporre Thorburn, Göteborg (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 14/009,623

(22) PCT Filed: Apr. 5, 2011

(86) PCT No.: PCT/SE2011/050402

§ 371 (c)(1), (2), (4) Date: Nov. 13, 2013

(87) PCT Pub. No.: WO2012/138267

PCT Pub. Date: Oct. 11, 2012

(65) Prior Publication Data

US 2014/0076915 A1 Mar. 20, 2014

(51) Int. Cl.
*B65H 1/00* (2006.01)
*B65D 5/00* (2006.01)

(52) U.S. Cl.
USPC ..... 221/33; 221/48; 221/1; 221/302; 221/22; 206/525; 206/259; 229/104; 229/109; 229/107; 229/44; 229/116.1; 229/906; 229/146; 229/902; 496/163; 426/88

(58) Field of Classification Search
CPC ..... G01K 3/04; G01K 11/06; G01K 11/12; G01N 31/229; G01N 33/02; B65D 5/02; B65D 2585/366; B65D 5/0209; B65D 5/0227; B65D 5/029
USPC ..... 221/48, 33, 1, 302, 22; 229/104, 109, 229/107, 44, 116.1, 906, 146, 902; 426/88; 206/525, 259; 493/163
See application file for complete search history.

(56) References Cited

U.S. PATENT DOCUMENTS

| | | | | | |
|---|---|---|---|---|---|
| 2,114,052 | A | * | 4/1938 | Kincade, Jr. | 229/110 |
| 3,121,525 | A | * | 2/1964 | Hayes | 206/523 |
| 3,765,594 | A | * | 10/1973 | Cramphorn | 229/106 |
| 3,807,624 | A | * | 4/1974 | Funkhouser | 206/427 |
| 3,940,054 | A | * | 2/1976 | Goebel et al. | 206/449 |
| 4,015,769 | A | * | 4/1977 | Erlich | 206/92 |
| 5,259,550 | A | * | 11/1993 | Kuchenbecker | 229/109 |
| 5,487,468 | A | * | 1/1996 | Sheahan | 206/242 |
| 5,527,988 | A | * | 6/1996 | Hernandez et al. | 174/17 LF |
| 6,026,983 | A | * | 2/2000 | Graham | 220/738 |

(Continued)

FOREIGN PATENT DOCUMENTS

FR 2869882 A1 11/2005

*Primary Examiner* — Rakesh Kumar
(74) *Attorney, Agent, or Firm* — Drinker Biddle & Reath LLP

(57) ABSTRACT

A dispenser box having a modified rectangular shape with leaf-shaped end walls and partly curved main walls that may form symmetrically or non-symmetrically configured halves of the dispenser box. The first main wall has a substantially flat surface extending from a first side edge of the dispenser box and changing into a curved surface when moving in a direction from the first side edge towards a second side edge of the dispenser box. The second main wall has a corresponding substantially flat surface at the second side edge, which changes into a curved surface when moving in a direction towards the first side edge.

19 Claims, 6 Drawing Sheets

(56) References Cited

U.S. PATENT DOCUMENTS

| | | | | |
|---|---|---|---|---|
| 6,155,480 | A * | 12/2000 | Botsford et al. | 229/122.1 |
| 6,349,849 | B1 * | 2/2002 | Pehr | 221/33 |
| 6,779,658 | B2 * | 8/2004 | Polloni et al. | 206/268 |
| 7,090,115 | B2 * | 8/2006 | Pierce | 229/109 |
| 7,172,092 | B2 * | 2/2007 | Yang et al. | 221/45 |
| 7,213,704 | B2 * | 5/2007 | Li Vigni et al. | 206/273 |
| 7,350,670 | B2 * | 4/2008 | Steeves et al. | 222/105 |
| 7,487,906 | B2 * | 2/2009 | Molinare et al. | 229/222 |
| 7,762,450 | B2 * | 7/2010 | Oliveira | 229/107 |
| D630,523 | S * | 1/2011 | Dragoo et al. | D9/711 |
| D651,831 | S * | 1/2012 | Becherer et al. | D6/518 |
| 8,225,985 | B2 * | 7/2012 | Oliveira | 229/107 |
| D670,999 | S * | 11/2012 | Stowe et al. | D9/416 |
| 8,408,419 | B2 * | 4/2013 | Rippl et al. | 221/305 |
| 8,523,435 | B2 * | 9/2013 | Doue | 383/2 |
| 8,608,051 | B2 * | 12/2013 | Focke et al. | 229/146 |
| 8,695,848 | B2 * | 4/2014 | Cook et al. | 221/305 |
| 2005/0178791 | A1 * | 8/2005 | Miller | 221/305 |
| 2006/0006078 | A1 * | 1/2006 | Vaccari et al. | 206/273 |
| 2006/0144909 | A1 * | 7/2006 | Kohlweyer | 229/104 |
| 2006/0254942 | A1 * | 11/2006 | Cargile, Jr. | 206/427 |
| 2007/0131703 | A1 * | 6/2007 | Szymonski et al. | 221/50 |
| 2008/0054012 | A1 | 3/2008 | Long | |
| 2010/0065620 | A1 * | 3/2010 | Smith | 229/109 |
| 2010/0163609 | A1 * | 7/2010 | Bull | 229/109 |
| 2011/0287146 | A1 * | 11/2011 | Stowe et al. | 426/88 |
| 2013/0264378 | A1 * | 10/2013 | Keberlein et al. | 229/109 |

* cited by examiner

DISPENSER

CROSS-REFERENCE TO PRIOR APPLICATION

This application is a §371 National Stage Application of PCT International Application No. PCT/SE2011/050402 filed Apr. 5, 2011, which is incorporated herein in its entirety.

TECHNICAL FIELD

The disclosure pertains to a dispenser box with a dispensing opening for dispensing of stackable sheet material contained within the dispenser box. The dispenser box has rectangular main walls extending between two end walls. The disclosure also pertains to a blank for forming the dispenser box.

BACKGROUND

A common type of combined package and dispenser for flexible consumer articles such as different kinds of wipes is a rectangular cardboard box in which the wipes are arranged in a likewise rectangular stack of sheets which can be removed from the box through a dispensing opening provided in the top surface of the box. The rectangular box shape is excellent with regard to stackability and economy of space during storage and transport. Moreover, as it can be safely stood on a countertop or a shop shelf resting on any one of its rectangular surfaces, it works very well as a stable and reliable package and dispenser.

However, a combined package and dispenser has numerous functions. It serves as an information bearing medium conveying information about the contents in the package and it provides protection, containment and dispensing of the consumer articles inside the package/dispenser. While placed on a shop shelf, it is desirable that as large an area of the package as possible may be exposed to a viewer of the package in order to convey information allowing determination of the type of article contained in the package, the brand of the article, the number of articles in the package and other information of relevance to a viewer such as a shop assistant or a presumptive buyer. However, bulky or oddly shaped containers which take up a proportionally large space on a shop shelf or during storage and transport and which cannot be efficiently stacked are not appreciated by the retail business.

Some examples of packages that may present a relatively larger exposed surface than a conventional rectangular box are disclosed in US 2006/0144909 A1, US 2008/0054012 A1 and FR 2 869 882 A1. All these packages have rounded surfaces allowing improved exposure of information printed on the packages. However, the prior art packages suffer from the drawback that they cannot accommodate conventional rectangular stacks of wipes or other sheet material without considerable distortion of the stack configuration. Moreover, the prior art packages cannot be stacked in a space conserving and stable manner.

Accordingly, there remains a need for an improved combined package and dispenser for stackable articles having good display properties as well as containment and dispensing functions.

SUMMARY

In accordance with the disclosure, there is provided a dispenser box for stackable sheet material, combining the various demands on an efficient and economical package with the demands on a practical and functional dispenser.

In a first aspect, a dispenser box for stackable sheet material includes:

first and second rectangular main walls each main wall having a first and a second end edge, the first end edges of the main walls defining a first end edge of the dispenser box and the second end edges of the main walls defining a second end edge of the dispenser box, and a first side edge of each main wall extending along a first side edge of the dispenser box and a second side edge of each side wall extending along a second side edge of the dispenser box, first and second end walls; and a dispensing opening.

The first side edge of the dispenser box extends between the first right-angled corners of the end walls and the second side edge of the dispenser box extends between the second right-angled corners of the end walls. The end edges of the main walls include a curved portion conforming to the curvature of the curved corners of the end walls and each main wall has a curved surface corresponding to the curved portions of the end edges of the main walls.

Accordingly, the dispenser box has a non-rectangular shape with "leaf-shaped" end walls and partly curved main walls that may form symmetrically or non-symmetrically configured halves of the dispenser box. The first main wall has a substantially flat surface extending from the first side edge of the dispenser box and changing into a curved surface when moving in a direction from the first side edge of the dispenser box towards the second side edge of the dispenser box. The second main wall has a corresponding substantially flat surface at the second side edge which changes into a curved surface when moving in a direction towards the first side edge.

Each of the end walls has a first and a second diametrically opposite right-angled corner and a first and a second diametrically opposite convexly curved corner. The convexly curved corners may have the same or different curvature. Moreover, the curvature of the convexly curved corners may be continuous or may be made up of three or more contiguous straight segments. The radius of the curve may be different in different parts of the convexly curved corner.

Due to the dispensing box body having only two major surfaces formed by the main walls instead of four or more as found in prior art dispensers, the available area for unbroken print is considerably increased without increasing the size of the dispensing box. Accordingly, the curved main walls provide the dispenser box with large continuous printable surfaces allowing unbroken print to be applied across the main walls from side edge to side edge. This means that the display properties of the dispenser box are considerably improved when compared to those of a conventional rectangular box. The improved display function is an advantage both when the dispenser box is placed in a service environment, such as on a table or on a counter-top and when it is on display for sale in a shop.

Despite the deviation from a pure rectangular or square shape, the dispensing box can still accommodate a conventional rectangular stack of flexible sheet material with only a slight influence on the shape of the stack. When placed in the dispenser box, the edge portions of a rectangular stack of sheet material being placed at the curved corners of the dispensing box will assume a slight curvature to fit the curvature of the dispensing box. This may lead to the edges of the individual sheets being slightly offset in relation to the edges of a neighbouring sheet. However, the dispensing box having two curved corners and two right-angled corners can accommodate a stack of sheets of the same general size and configuration as a corresponding conventional dispensing box having four right-angled corners. When placing the stack of sheets in the dispensing box, there is no need of folding the stack or otherwise appreciably distort the shape of the stack.

A box having a leaf-shaped cross-sectional area with two right-angled corners and two curved corners can be made to fit very comfortably in a hand, rendering the box easy to grip, hold and handle. In addition, the curved edges of the dispenser box reduces the material consumption for the box which is an advantage in particular when the box is of the disposable kind where cost savings are a greater concern than for more durable types of dispensers.

The dispenser may be made in different sizes and with different proportions between the curved and flat surfaces, as disclosed herein.

The convexly curved corners may have any suitable radius of curvature or combination of radii of curvature, up to and including two times a height or a width of the dispenser box. The radius of curvature of the convexly curved corners may be greater than 1 mm and less than or equal to a height or a width of the dispenser box.

The dispensing opening can be placed in any wall of the dispenser box, such as in an end wall or in a main wall. Depending on the type of sheet product contained in the dispenser box, it may be preferred that the dispensing opening is arranged in a main wall. The dispensing opening may have a leaf-shaped contour matching the shape of the end walls. Furthermore, the dispensing opening may be covered with a protective film having a dispensing slit, or may be provided with other means for preventing a partially withdrawn sheet from falling back into the container. Other means of protecting the sheets before dispensing may be employed such as a removable protective wrapping enclosing the whole dispenser box or a protective tape that is removed to expose the opening. Furthermore, the package does not need to have a dispensing opening that is covered before use of the wipes in the package. In addition, arrangements for pulling out a first sheet article from a new dispenser box may be provided. Such arrangements at the dispensing opening are known to the person skilled in the art and will not be further discussed herein.

The dispensing opening may be created by a user of the dispensing box at the location for use by tearing away a portion of the dispensing box material along a perforation line or other line of weakness defining the contour of the dispensing opening. Accordingly, when the dispensing box is to be made ready for dispensing of the sheets contained therein, the opening is uncovered by tearing away the box material inside the weakening line, thus allowing a sheet to be pulled out through the opening. In order to facilitate removal of the box material at the dispensing opening a small gripping opening and/or a cut line may be provided at an edge of the line of weakness.

The dispensing opening may be arranged in a flat surface of the dispensing box, in a curved surface of the dispensing box or may extend with a portion of the opening in a flat surface and another portion of the opening in a curved surface.

The dispensing opening may be arranged in a main wall and/or in an end wall.

Two or more dispensing openings may be arranged in the dispenser box. The openings may be placed in the same wall or in different walls. The arrangement of the openings may allow a user to choose which dispensing opening to use. If the dispensing openings are protected by a covering such as a part of the dispenser box material inside the contour of a line of weakness, the user may choose to uncover only one opening or more than one opening, as found suitable.

The dispenser box walls may be made from a material selected among: cardboard, plastic sheet materials, paper or plastic foam materials, metal foil, and laminates and combinations of one or more of these materials. For disposable dispenser boxes, the material can be a relatively inexpensive, pliable material that can easily be bent and folded when producing the dispenser box of the invention having curved corners and distinct, 90° corners. However, in particular embodiments, the material is sufficiently rigid to be self-supporting when formed into a dispenser box so that the shape of the dispenser box is retained under normal in-use conditions throughout the useful life of the dispenser box. Moreover, it may be desired that the dispenser box can be folded together or crushed by hand for disposal after emptying. The material in the dispenser box may also be recyclable.

Each end wall of the container box may be made up of at least one end panel. When only one end panel is used to form an end wall, the end panel generally defines the shape of the end wall. However, the end walls may include two or more partly or completely overlapping end panels. End panels having equal shape and size will be completely overlapping. Partly overlapping arrangements range from those where edge portions of the end panels are overlapped only sufficiently to allow the end panels to be directly connected to each other to those where the end panels have the same shape but slightly different size. The latter configuration may facilitate folding of two end panels having the same shape on top of each other so that a first end panel is arranged inside of a second end panel. The first or inner end panel may have a slightly smaller area then the second or outer end panel in order to accommodate the inner end panel inside the end edges of the main panels. The size difference may be very small, such as when overlapped the peripheral edges of the smaller end panel will be located at a distance of up to and including 1.5 mm from the peripheral edges of the larger end panel. In yet other useful arrangements, the end panels may be arranged edge-to-edge and may be indirectly connected such as by a further, overlapping end panel, by a connecting strip, or similar connecting or closure means. Overlapping end panels may be useful to increase the shape stability and crush resistance of the box dispenser. Particularly stable box dispensers are obtained when completely or practically completely overlapping end panels are employed.

In order to further increase stability and deformation resistance of the box dispenser, at least one end tab may be arranged extending from the end edge and being attached to an inner surface of an end panel at each end wall of the dispenser box. The purpose of using such end tabs is to create connections between the inner surface of the end panel and the end edge of the dispenser box. An end tab typically has considerably smaller surface area than an end panel, such as less than 50% of the surface area of an end panel and often as little as 5-10% of the surface area of the end panel. The end tab may be placed anywhere on the periphery of the end edge of the dispenser box. If placed close to a right-angled corner of the dispenser box, it may serve as a shape-stabilising reinforcement of the corner.

The end walls of the dispenser box may be arranged flush with the end edges of the walls. This arrangement provides the dispenser box with a smooth outer surface without sharp edges that may otherwise be found in boxes made from cardboard, plastic film or other relatively thin, pliable sheet materials. Sharp edges may scratch or even cut the skin of a person handling the dispenser box, and should preferably be avoided.

The first side edge of the dispenser box may be defined by a fold line between two main wall panels and the second side edge of the dispenser box may be defined by a join between the main wall panels. Such configuration may result from the main wall panels being parts of a coherent dispenser box blank. As non-limiting examples, the main wall panels may be formed from one and the same piece of sheet material or may be formed from a non-transparent base material having a window formed from a transparent material. Alternatively, the dispenser box may be formed from two or more separate blanks that are joined together, for instance along the right-angled side edges of the main walls and/or along the end edges of the main walls.

The curved portions of the first and second main walls may be continuously curved without creases or folds between the side edges of the dispenser box so as to render the main walls smooth. By minimizing the amount of irregularities such as joins or creases in the surface of the main walls, the printable area of the dispenser box may be maximized.

As used herein, a sheet article is a generally two-dimensional article such as a wipe, a bed cover or seat cover, a surgical drape, a wound dressing, or similar. Wipes do often have a rectangular or square planar shape and may have been folded one or more times. The sheet articles are flexible in the sense that they may be manually bent or folded. A sheet article may include one or more layers or plies of the same or different kinds of materials.

Wipes in the form of sheets of material intended for wiping and for hygienic purposes are common household items that may be provided in the form of stacks or rolls of wipes from which individual wipes can be readily removed when needed. The wipes may be any kind of wet or dry wipe such as household paper, napkins, disposable handkerchiefs, facial tissue, industrial wipes, toilet paper, etc. The material may be a fibrous material of any suitable kind such as cellulose based paper material, with or without admixture of man-made fibres, binders and fillers. The wipes may include only man-made fibres. However, it is usually desired that a wipe has some degree of absorbency or that it at least is wettable. If the fibrous material contains a large proportion of fibres of a hydrophobic character implying that the fibres are non-wettable by aqueous fluids, it may be suitable for wiping oily or greasy surfaces. A hydrophobic material may be treated with a wetting agent in order to make it more hydrophilic. The wipes may have any suitable shape and/or size and may be embossed, perforated, printed and dyed if desired. The wipes may be single-ply sheets of material or may include two or more plies of the same or different materials. The wipes may contain additives such as lotions, perfumes, detergents, liquids, etc. as known in the art.

When the wipes are in the form of a stack or a roll they may be discrete sheets of wiping material or a continuous web from which individual wipes may be separated. Discrete sheets of wiping material may be interlinked to form a continuous chain of wipes being held together by frictional forces. Such interlinked sheets are available in roll form or as a stack of interfolded sheets.

Interfolded wipes are sheets of material arranged in a stack of superposed sheets which are each folded at least once. The sheets are interlinked in such a way that the separate folded sheets of material form a chain of sheets where each sheet has a leading panel and a trailing panel, the trailing panel being at least partly overlapped with the leading panel of the subsequent sheet in the stack. In this manner, the individual sheets are held loosely together by means of frictional forces arising between the overlapping parts of the panels. When more complicated folding arrangements are used, the leading and trailing panels may be separated by one or more intermediate panels. In a simple folding arrangement, the leading panel will be contiguous with the trailing panel following directly after the leading panel. The wipes may be single ply or multi ply wipes and may be folded one or more times in a second direction perpendicular to the first, interfolding direction. The sheets may be dispensed from the opening in the dispenser box by pulling at the leading panel of the first sheet in the stack. In this manner, the first sheet is extracted at the same time as a predetermined part of the leading panel of a subsequent sheet is pulled through the dispensing opening into a dispensing position where it may subsequently be gripped and removed from the dispenser.

The sheet material contained in the dispenser box may be a clip, i.e. a stack of sheet articles that have been pre-bent into a U-shape. However, in a particular embodiment, the dispenser box contains a rectangular stack of sheet articles. The stack may be a rectangular stack and the sheet articles may be interfolded wipes.

In a second aspect, a blank for producing a dispenser box having two curved and two right-angled corners. The blank includes first and second rectangular main panels having first and second side edges and first and second end edges. The main panels are interconnected by a side edge fold line constituting the first side edges of the main panels. The blank further includes at least one end panel interconnected with each of the end edges of the main panels by an end edge fold line having first and second ends. The at least one end panel has a right-angled corner and a convexly curved corner at either end of the edge fold line.

A box dispenser may be formed from a blank including two main panels interconnected by a fold line along first side edges of the main panel and having a first and a second identically shaped end panels connected to each end edge of the main panels and at least one stabilizing tab at each end edge of the main panels. The process for forming the box dispenser from such a blank may include the steps of:

a) folding the blank along the side edge fold line;
b) interconnecting the second side edges of the main panels to form a tubular main box dispenser body;
c) folding in the first end panel at the end edges of the main panels;
d) folding in the at least one stabilizing tab; and
e) folding in the second end panel.

The stabilizing tabs may be two or more and the end panels may have the same or slightly different size such that the first end panel is slightly smaller than the second end panel.

The dispenser may be sealed by gluing together the second side edges of the main panels or by any other suitable sealing means such as heat sealing, ultrasonic welding, stapling, taping, etc., as known in the art. End sealing may similarly be made by gluing together overlapping end panels, such as outer and inner identically shaped leaf-shaped end panels. Stabilizing tabs may be provided on the dispenser box blank anywhere along the end edges of the main panels outside the fold lines between the main panels and the end panels. As previously mentioned, the stabilizing tabs may be placed near or in the non-rounded corners of the end panels.

BRIEF DESCRIPTION OF THE DRAWINGS

Embodiments of the invention will be described in greater detail below with reference to the figures shown in the appended drawings.

DETAILED DESCRIPTION OF PREFERRED EMBODIMENTS

Figure 1:
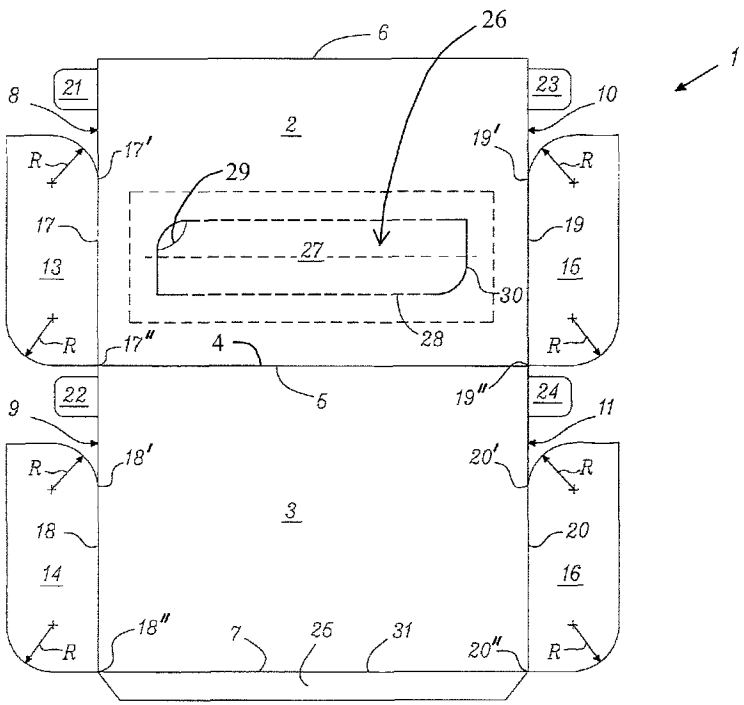
FIG. 1 shows a dispenser box blank according to an embodiment of the invention.

The dispenser box blank 1 shown in FIG. 1 includes a first rectangular main panel 2 and a second rectangular main panel 3. Each main panel 2,3 has a first side edge 4,5 and a second side edge 6,7, first end edges 8,9 and second end edges 10,11. The main panels 2,3 are interconnected by a side edge fold line 12 forming the first side edges 4,5 of the main panels 2,3. A first end panel 13,14 is arranged along each first end edge 8,9 of the first and second main panels 2,3 and a second end panel 15,16 is arranged along each second end edge 10,11 of the first and second main panels 2,3. The end panels 13-16 are connected to the end edges 8-11 of the main panels 2,3 by end panel fold lines 17-20 each having first and second ends 17', 17"; 18', 18"; 19', 19"; and 20', 20". The end panels 13-16 each have an inner right-angled corner placed at the second ends 17", 18", 19", 20" of the end panel fold lines 17-20 and an inner convexly curved corner with a radius of curvature R at the first ends 17', 18', 19', 20' of the end panel fold lines 17-20. Each end panel 13-16 also has an outer right-angled corner and an outer convexly curved corner diametrically opposite the corresponding inner right angled corner and convexly curved corner.

As is shown in FIG. 1, the end panels 13,15 on the first main panel 2 have the same shape but slightly different size when compared to the end panels 14,16 on the second main panel 3. Such configuration of the end panels may be used to facilitate folding in of two end panels on top of each other when forming the end walls of a dispenser box. When forming a dispenser box from the blank in FIG. 1 and folding the end panels 13-16 into an overlapping configuration, the smaller end panels 13,15 which in FIG. 1 are shown to extend from the end edges 8,10 of the first main panel 2 will be folded first followed by the larger end panel 14,16 extending from the second end panel 3. This will result in the smaller end panels 13,15 being arranged inside of the larger end panels, as is shown in FIGS. 5 and 6. The size difference between the smaller end panels 13,15 and the larger end panels 14,16 may be very small, such as when overlapped the peripheral edges of the smaller end panels 13,15 will be located a distance, d, of up to and including 1.5 mm inside of the peripheral edges of the larger end panels 14,16.

The sizes and proportions of the different panels of the dispenser box blank 1 in FIG. 1 are only intended to be an example of one of many possible configurations within the scope of the invention. Accordingly, it is to be understood that the size and proportions of the different panels may be varied in order to produce dispenser boxes of different sizes and proportions as long as the resulting dispenser box has two right-angled corners and two curved corners as set out herein. Moreover, the end panels may be shaped so that each end panel only makes up a part of an end wall of a dispenser box implying that the surface of the end wall includes more than one end panel.

The dispenser box blank 1 is further provided with stabilizing tabs 21-24 arranged at the end edges 8-11 of the main panels 2,3 outside the end panel fold lines 17-20 between the main panels 2,3 and the end panels 13-16. As previously mentioned, the stabilizing tabs 21-24 may be placed near or in the right-angled corners of the end panels 13-16 as shown in FIG. 1. The stabilizing tabs are optional and may be omitted, if desired. When present, the stabilizing tabs may be placed closer to the end panels 13-16 and more than one stabilizing tab may be placed along each end edge 8-11 of the main panels 2,3.

A sealing panel 25 is arranged along the second side edge 7 of the second main panel 3. The sealing panel 25 is connected to the second main panel 3 by a sealing panel fold line 31 coinciding with the second side edge 7 of the second main panel 3. The sealing panel is optional and may be replaced by other sealing means such as multiple stabilizing tabs, a sealing tape, etc.

The dispenser box blank 1 further has a line of weakness 28 defining the contour of a dispensing opening 26 in the first main panel 2. A removable protective panel 27 formed by the blank material is found inside the line of weakness 28. The line of weakness may be formed by means any suitable means such as perforations, thinned portions of the blank material, partial cuts through the thickness of the material or combinations of through-cut segments 30 with other types of weakening means. The opening 26 in the FIG. 1 dispenser box blank 1 is further shown to have a small cut out portion 29 at one end of the dispensing opening 26. Such cut out portion 29 may be provided as a finger grip but is optional.

The dispenser box blank 1 may be formed into a dispenser box by bringing the second side edges 6,7 of the main panels 2,3 together and attaching a side edge portion of the first main panel 2 to the sealing panel 25, thus forming the main panels into a closed loop with distinct folds along the side fold line 12 and the sealing panel fold line 31.

The dispenser box is thereafter given its final three-dimensional shape by folding in the end panels 13-16 and the stabilizing tabs 21-24 if present, attaching the innermost end panels 13-15 to the stabilizing tabs 21-24 and attaching the outermost end panels 14,16 to the corresponding inner end panels 13,15. When all attachments are made, the resulting dispenser box is given the desired shape with two diametrically opposite right-angled corners and two diametrically opposite curved corner. The end edges 8-11 of the main panels 2,3 are forced to conform to the shape of the peripheral edges of the end panels, bringing the main panels 2,3 to bend and fold in the appropriate parts and giving the resulting dispenser box a shape-stable three-dimensional configuration.

Attachment of the different panels to each other may be made by gluing or by using any other suitable bonding method or combination of bonding methods such as heat sealing, ultrasonic welding, stapling, taping, etc., as known in the art.

Figure 2:
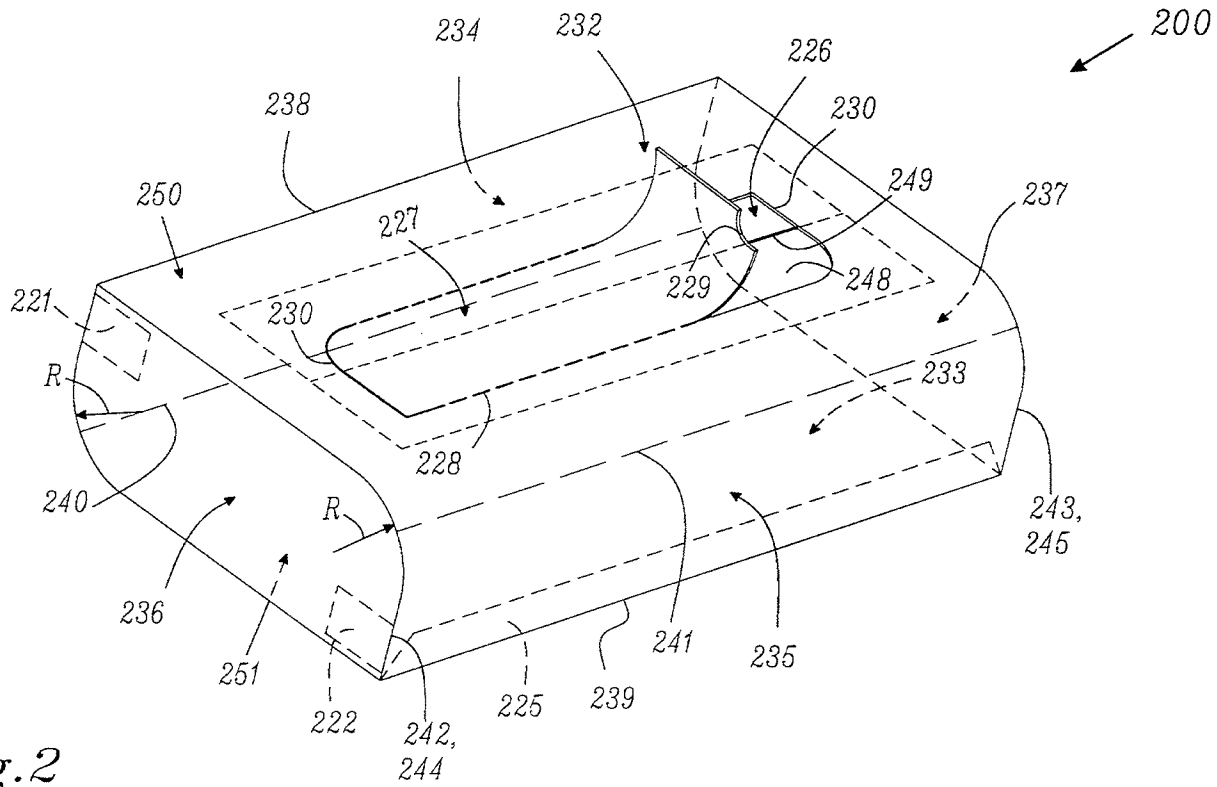
FIG. 2 shows a first dispenser box according to an embodiment of the invention.

The dispenser box 200 shown in FIG. 2 has a modified parallelepiped shape. The box may be suitable for packaging and dispensing of a rectangular stack of wipes, e.g. interfolded tissue or nonwoven napkins. When looking at FIG. 2, the dispenser box 200 is seen to have a top wall 232, a bottom wall 233, a first side wall 234, a second side wall 235 and two end walls 236, 237. The dispenser box shape deviates from a regular rectangular parallelepiped shape in that it has first and second diametrically opposite distinct longitudinal side edges 238, 239 extending along right-angled corners of the dispenser box 200 and first and second diametrically opposite diffuse longitudinal side edges 240, 241 extending along convexly curved corners of the dispenser box 200. The convexly curved corners have a radius of curvature, R, implying that the longitudinal side edges 240, 241 extending along the convexly curve corners appear diffuse to a viewer of the dispenser box 200 and that there is no visually identifiable distinct delimitation between the top wall 232 and the second side wall 235 or between the bottom wall 233 and first side wall 234. Instead, the top wall 232 is perceived as successively changing into the second side wall 235 at the second diffuse side edge 241 and the bottom wall 233 is perceived as successively changing into the first side wall 234 and the first diffuse side edge 241. An alternative way of expressing this configuration is that the dispenser box 200 has a first main wall 250 formed by the top wall 232 and the second side wall 235 and a second main wall 251 formed by the bottom wall 233 and the first side wall 235 the main walls 250, 251 together making up a dispenser box main body.

The end walls 236,237 of the dispenser box 200 each have a first and a second diametrically opposite right-angled corner and a first and a second diametrically opposite convexly curved corner so that the end walls are generally leaf-shaped with peripheral edges 242, 243 conforming to the end edges 244, 245 of the top and bottom walls 232, 233 and the side walls 234, 235.

A dispensing opening 226 is shown to be arranged in a planar part of the top wall 232. The dispenser box 200 is shown with the dispensing opening 226 covered by box material. The contour of the opening 226 is marked in the box material by a line of weakness 228 in the top wall 232 of the dispenser box 200. In the dispenser box 200 shown in FIG. 2, the major part of the line of weakness 228 includes perforations 228 while completely cut segments 230 are arranged at the end parts of the opening 226. A small cut-out portion 229 is arranged at one end of the opening 226 serving as a finger grip allowing a user to easily grasp the end of the box material inside the line of weakness 228 and pull away the material protecting the opening 226 in the way indicated in FIG. 2.

Beneath the removable protective box material is placed flexible sheet 248 such as a plastic film or a paper having a centrally arranged dispensing slit 249 extending in the length direction, L, of the dispensing box 200. The dispensing slit 249 may be a perforation or other weakening in the flexible sheet 248 or may be a through-going cut in the sheet 249. Combinations of cuts and weakening lines may also be used. The inner flexible sheet 248 constitutes a protection against soiling of the contents in the dispenser box and also prevents a partially withdrawn sheet from falling back into the box. The inner flexible sheet is optional to the dispensing box. Moreover, if an inner flexible sheet is present, the configuration of the dispensing slit may be different from that shown in FIG. 2 and may take on any suitable shape as known in the art such as wave shaped, etc. The ends of the dispensing slit may also have a different configuration such as X-shaped, star-shaped, Y-shaped, U-shaped, etc. It is also known to arrange flaps or guiding elements at the opening in order to prevent fall-back of a partially withdrawn sheet. The dispenser box may also include a "start feature" facilitating removal of a first sheet article from the dispenser box.

The configuration of the dispensing opening 226 shown in FIG. 2 is not limiting and is only intended as an example of a suitable dispensing opening. Accordingly, it is to be understood that the dispensing opening may have other shapes than that shown in FIG. 2, such as oval, rectangular, circular, square, star shaped, wave shaped, etc. Moreover, the dispensing opening may be placed in a different location on the dispensing box such as in a side wall or in one of the end walls. The dispensing opening may be placed in a curved surface of the dispensing box or may extend over both curved and planar parts of the dispenser box surface.

It is also to be understood that the line of weakness 228 shown in FIG. 2 may be differently configured. Accordingly, the perforations may extend along the whole periphery of the opening or cut-lines may be differently placed along the periphery of the opening. The cut-out finger-grip may be omitted or may be replaced with a gripping-tab attached to the box material inside the periphery of the line of perforation. It is also possible to provide more than one cut-out finger-grip at the edge of the opening. As set out herein, more than one dispensing opening may be arranged in the dispenser box.

When the dispenser box 200 is to be made ready for dispensing of its contents, the opening 226 is uncovered by tearing away the box material inside of the line of weakness 228 thereby exposing the contents in the box. When the dispenser box 200 has been opened, the articles in the dispenser box 200 can be successively pulled out through the opening 226. If desired, other means of protecting the contents in the dispenser box 200 before dispensing may be employed instead of or in addition to a removable part of the box material. Such protective means include removable protective wrappings enclosing the whole package or protective tapes that are removed to expose the opening.

The dispenser box 200 in FIG. 2 is made of a relatively rigid but pliable material such as cardboard, plastic, etc. Accordingly, the dispenser box 200 is intended to maintain its modified parallelepiped shape throughout its useful life.

The dispenser box 200 in FIG. 2 has a generally flat shape with smaller extension in the height direction, H, than in the width direction, W, and length direction, L. This makes the dispenser box 200 easy to grip and handle by an individual when placing it in a location for use or when moving it between different locations. The curved portions at the diffuse side edges 240, 241 fit comfortably in a human hand and allow the dispenser box to be securely held also while pulling out articles through the dispensing opening 26. The end walls of the dispenser box can be configured such that 0.1 W is smaller than or equal to H which is smaller than or equal to W in order to optimize the curvature at the curved corners of the end walls.

The dispenser box 200 may be placed with the bottom wall 233 resting on a service surface such as a counter top, or a wash stand, etc. and will remain stably resting on the bottom wall 233 during use. The shape of the dispenser box 200 allows conventionally stacked sheet articles such as rectangular stacks of tissue napkins, or other kinds of wipes to be packaged and dispensed from the box without any appreciable amount of distortion of the shape of the stack of articles from the rectangular form.

When placed on a shelf, with a side wall facing towards a viewer, the curvature of the edge between the side wall and the adjoining top or bottom wall allows the viewer to see not only the side wall but also a portion of the adjoining top or bottom wall. Thereby, the exposed surface for conveying information arranged on the dispenser box is considerably larger than a corresponding exposed surface of a conventional rectangular dispenser box.

Figure 3:
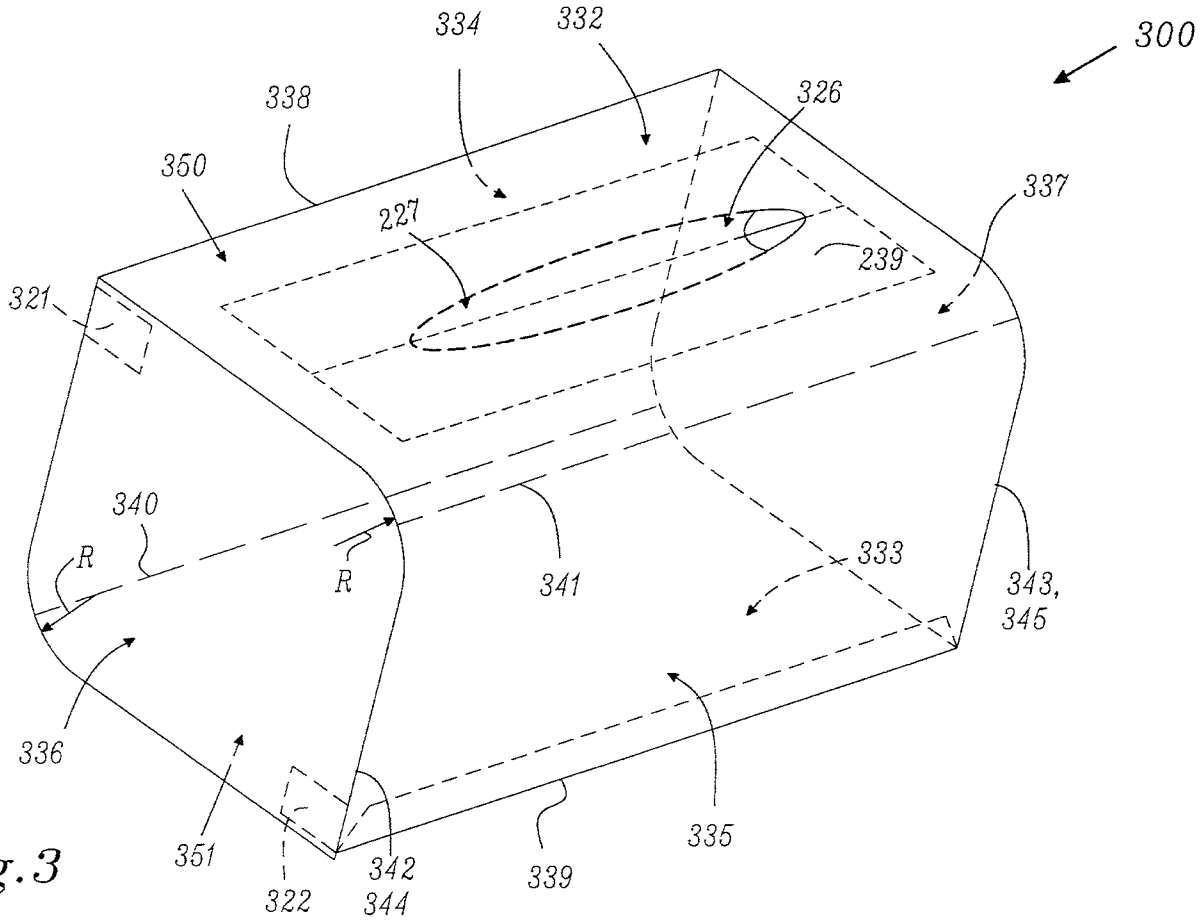
FIG. 3 shows a second dispenser box according to an embodiment of the invention.

The dispenser box 300 in FIG. 3 differs from that in FIG. 2 only in the shape of the end walls and in the shape of the dispensing opening. Accordingly, the dispenser box 300 shown in FIG. 3 has a modified parallelepiped shape and is seen in FIG. 3 to have a top wall 332, a bottom wall 333, a first side wall 334, a second side wall 335 and two end walls 336, 337. The dispenser box 300 has first and second diametrically opposite distinct longitudinal side edges 338, 339 extending along right-angled corners of the dispenser box 300 and first and second diametrically opposite diffuse longitudinal side edges 340, 341 extending along convexly curved corners of the dispenser box 300. The convexly curved corners have a radius of curvature, R, implying that the longitudinal side edges 340, 341 extending along the convexly curve corners appear diffuse to a viewer of the dispenser box 300 and that there is no visually identifiable distinct delimitation between the top wall 332 and the second side wall 335 or between the bottom wall 333 and first side wall 334. Instead, the top wall 332 is perceived as successively changing into the second side wall 335 at the second diffuse side edge 341 and the bottom wall 333 is perceived as successively changing into the first side wall 334 and the first diffuse side edge 341.

The end walls 336,337 of the dispenser box 300 each have a first and a second diametrically opposite right-angled corner and a first and a second diametrically opposite convexly curved corner so that the end walls are generally leaf-shaped with peripheral edges 242, 243 conforming to the end edges 244, 245 of the top and bottom walls 332, 333 and the side walls 334, 335.

In order to illustrate that the shape of the dispensing opening 326 may be freely chosen, the dispenser box 300 in FIG. 3 is shown having an oval dispensing opening. 326.

The dispenser box 300 is shown with a greater length dimension, L, than width, W, or height, H. In particular embodiments, a dispensing opening for dispensing of a stack of sheet articles having a greater length dimension than width dimension has an elongated shape as shown in FIGS. 2 and 3 to avoid excessive wrinkling of the dispensed articles when pulling them through the dispensing opening. However, in dispenser boxes having a more square shape, the dispensing opening or openings may have shapes with less or no difference in size in perpendicular directions.

Figure 4:
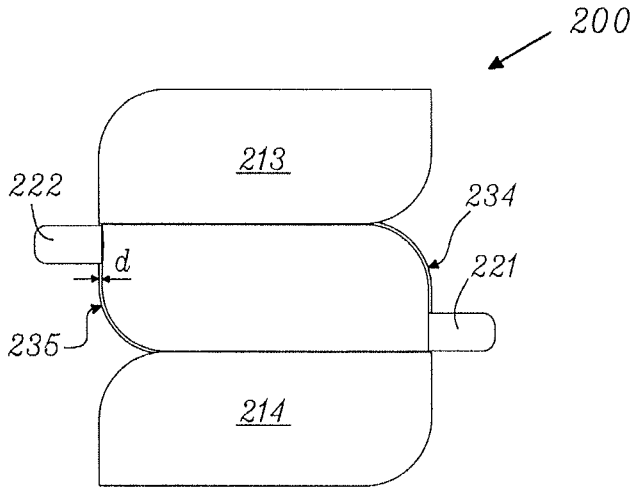
FIG. 4 shows an end view of the FIG. 2 dispenser box before sealing of the end panels.
Figure 5A:
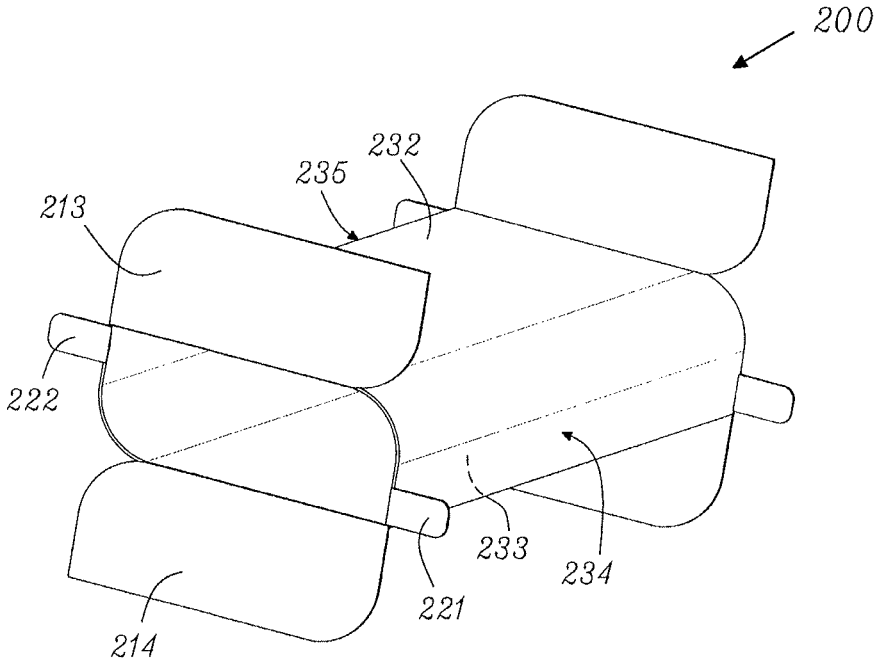
FIG. 5*a* shows a perspective view of the FIG. 2 dispenser box before sealing of the end panels.
Figure 6:
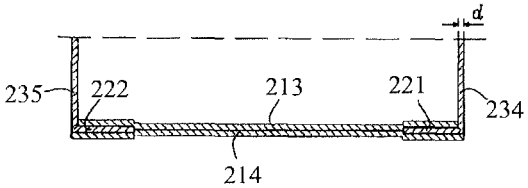
FIG. 6 shows a section along the line VI-VI through the dispenser box in FIG. 5.

FIG. 4 shows an end view of the dispenser box 200 before the end walls have been formed and FIG. 5*a* shows a perspective view of the dispenser box 200 with open ends. The dispenser box 200 is shown to have a first end panel 213 extending from a straight portion of an end edge 244 of the dispenser box body formed by the top wall, 232, the bottom wall 233 and the side walls 234, 235. An identically shaped second end panel 214 extends from a straight portion of the end edge 244 of the dispenser box body located directly opposite the first end panel 213. The end panels 213, 214 are hingedly connected to the dispenser box body, such as by means of a fold in the box material. Stabilizing tabs 221, 222 are shown to be extending outwardly from the end edge 244 of the dispenser box 200, near the right-angled corners.

Figure 5B:
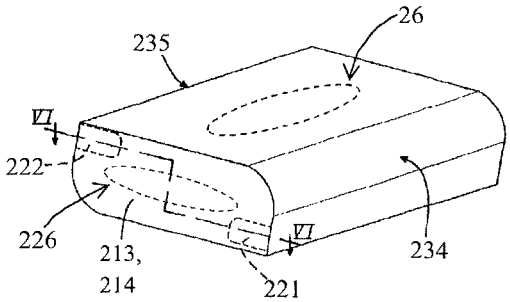
FIG. 5*b* shows a perspective view of the FIG. 2 dispenser box with sealed end panels.

In FIG. 5*b*, the end of the dispenser box 200 is shown in a closed configuration with the end panels 213, 214 folded in on top of each other generally flush with the end edge 244 of the dispenser box main body 250,251 and with the first end panel 213 located on the inside of the second end panel 214. The first and second end panels 213, 214 have the same shape but have slightly different size. The difference in size of the end panels 213, 214 facilitates folding in of the two end panels on top of each other when forming the end walls of the dispenser box and increases the stability of the dispenser box. When folding the end panels 213 and 214 into an overlapping configuration as shown in FIGS. 5*b* and 6, the smaller end panel 213 is folded first followed by the larger end panel 214. In this manner, the smaller end panel 213 will be pushed somewhat into the dispenser box body at the end edge 244 thereof, as is shown in FIG. 6. The size difference between the smaller end panel 213 and the larger end panel 214 may be very small, and is generally of the same order as the sheet thickness of the dispenser body material. Accordingly, when the end panels 213, 214 are in the overlapped configuration, the peripheral edges of the smaller end panel 213 will be located a distance, d, of up to and including 1.5 mm inside of the peripheral edges of the larger end panel 214. By fitting inside of the edge of the dispenser box body, the peripheral edge of the smaller end panel 213 may support the end edge 244 of the dispenser box body and act as a stabilising member increasing shock resistance and counteracting deformation of the dispenser box body. It is further conceivable that both end panels 213,214 to have the same shape and to be sized so that they both fit inside the peripheral edge of the dispenser box body. The dispenser box 200 in FIG. 5*b* is also shown with an end wall opening 226 as well as an opening 26 as previously described. The end wall opening 226 can be formed from aligned openings in each end panel 213,214. For simplicity, end wall opening 226 is not shown in FIG. 6.

The end walls of the dispenser box having equally shaped end panels, such as the dispenser box in FIGS. 2, 3, 4, 5*a* and 5*b* may be formed by first folding in the first end panel 213, thereafter the stabilizing tabs 221,222 and finally the second end panel 214. Such folding sequence provides the dispenser box with particularly high end shape stability. However, a conventional folding sequence such as first folding in of the stabilizing tabs followed by folding in of the end panels may be used if desired. It is also possible, to fold in one end tab, then an end panel, then the other end tab and finally the other end panel. The end tabs may be folded in last, on the outside of the second end panel or the end tabs may be completely omitted and be replaced by tapes.

Figure 7A:
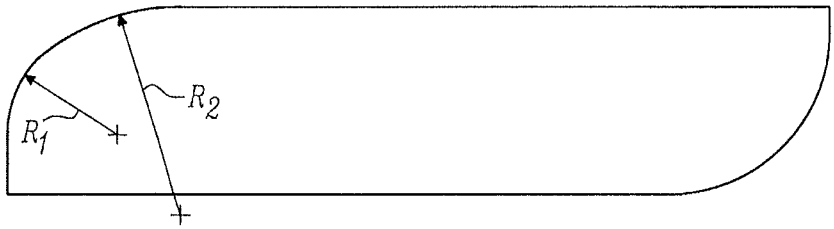
FIGS. 7*a* and 7*b* show end walls of a dispenser box according to an embodiment of the invention.

FIG. 7*a* shows an end wall of a dispenser box and illustrates that the radius of curvature may be different in different parts of a convexly curved corner of the end wall. Accordingly, in FIG. 7*a*, $R_1 \neq R_2$.

Figure 7B:
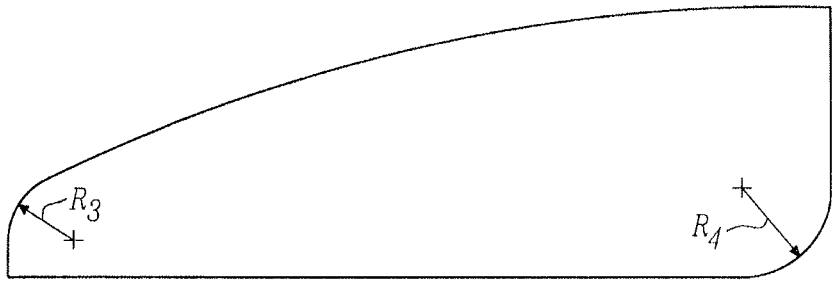

FIG. 7*b* shows an end wall of a dispenser box and illustrates that the two curved corners may have different radii of curvature. Accordingly, in FIG. 7*b*, $R_3 \neq R_4$.

The invention claimed is:

1. A dispenser box for stackable sheet articles, said dispenser box comprising:

first and second rectangular main walls each main wall having a first and a second wall end edge, a first dispenser end edge of said dispenser box defined by said first wall end edge of said first main wall and said first wall end edge of said second main wall, a second dispenser end edge of said dispenser box defined by said second wall end edge of said first main wall and said second wall end edge of said second main wall, a first wall side edge of said first main wall and a first wall side edge of said second main wall extending along a first dispenser side edge of said dispenser box and a second wall side edge of said first main wall and a second wall side edge of said second main wall extending along a second dispenser side edge of said dispenser box, first and second end walls; and a dispensing opening, wherein each said end wall has a first and a second diametrically opposite right-angled corner and a first and a second diametrically opposite convexly curved corner wherein said first dispenser side edge of said dispenser box extends between said first right-angled corners of said end walls and said second dispenser side edge of said dispenser box extends between said second right-angled corners of said end walls, wherein said first wall end edge of said first main wall and said first wall end edge of said second main wall extend between said first and second diametrically opposite right-angled corners of said first end wall, and said second wall end edge of said first main wall and said second wall end edge of said second main wall extend between said first and second diametrically opposite right-angled corners of said second end wall, and wherein said first and second wall end edges of said first and second main walls comprise a curved portion conforming to said curvature of said curved corners of said end walls and each said main wall has a curved surface corresponding to said curved portions of said wall end edges of said main walls.

2. The dispenser box according to claim 1, wherein the radius of curvature of said convexly curved corners is greater than 1 mm and less than or equal to a height or a width of said dispenser box.

3. The dispenser box according to claim 1, wherein said dispensing opening is arranged in a main wall.

4. The dispenser box according to claim 1, wherein said dispensing opening is arranged in an end wall.

5. The dispenser box according to claim 1, wherein two or more dispensing openings are arranged in said dispenser box.

6. The dispenser box according to claim 1, wherein said dispenser box walls are made from a material selected from the group consisting of: cardboard, plastic sheet materials, paper foam materials, plastic foam materials, metal foil, and laminates and combinations thereof.

7. The dispenser box according to claim 1, wherein each said end wall comprises at least one end panel.

8. The dispenser box according to claim 7, wherein said end walls comprise two overlapping end panels.

9. The dispenser box according to claim 8, wherein said overlapping end panels have equal shape.

10. The dispenser box according to claim 1, wherein the dispenser box contains a rectangular stack of interfolded wipes.

11. The dispenser box according to claim 1, wherein said end walls are arranged flush with said wall end edges of said main walls.

12. The dispenser box according to claim 1, wherein said first side dispenser edge of said dispenser box is defined by a fold line between two main wall panels and said second dispenser side edge of said dispenser box is defined by a join between said main wall panels.

13. The dispenser box according to claim 1, wherein said curved portions of said first and second main walls are continuously curved without creases or folds between said first and second dispenser side edges of said dispenser box.

14. A blank for producing the dispenser box according to claim 1, wherein said blank comprises first and second rectangular main panels having first and second side edges and first and second end edges, said main panels being interconnected by a side edge fold line constituting said first side edges of said main panels and comprising at least one end panel being interconnected with each said end edge of said main panels by an end edge fold line having first and second ends, said at least one end panel having a right-angled corner and a convexly curved corner at the ends of said edge fold line.

15. The blank according to claim 14, wherein two end panels are interconnected with each said end edges of said main panels.

16. The blank according to claim 15, wherein said two end panels have identical shape.

17. The blank according to claim 16, wherein at least one stabilizing tab is interconnected with each said end edges of said main panels.

18. A process for forming a box dispenser from the blank according to claim 17, comprising the steps of:

a) folding said blank along said side edge fold line;

b) interconnecting said second side edges of said main panels to form a tubular main box dispenser body;

c) folding in the first end panel at said end edges of said main panels;

d) folding in said at least one stabilizing tab; and e) folding in said second end panel.

19. A dispenser box for stackable sheet articles, said dispenser box comprising:

first and second rectangular main walls each main wall having a first and a second wall end edge, a first dispenser end edge of said dispenser box defined by said first wall end edge of said first main wall and said first wall end edge of said second main wall, a second dispenser end edge of said dispenser box defined by said second wall end edge of said first main wall and said second wall end edge of said second main wall, a first wall side edge of said first main wall and a first wall side edge of said second main wall extending along a first dispenser side edge of said dispenser box and a second wall side edge of said first main wall and a second wall side edge of said second main wall extending along a second dispenser side edge of said dispenser box, first and second end walls; and a dispensing opening, wherein each said end wall has a first and a second diametrically opposite right-angled corner and a first and a second diametrically opposite convexly curved corner wherein said first dispenser side edge of said dispenser box extends between said first right-angled corners of said end walls and said second dispenser side edge of said dispenser box extends between said second right-angled corners of said end walls, wherein said first wall end edge of said first main wall and said first wall end edge of said second main wall extend between said first and second diametrically opposite right-angled corners of said first end wall, and said second wall end edge of said first main wall and said second wall end edge of said second main wall extend between said first and second diametrically opposite right-angled corners of said second end wall, and wherein said first and second wall end edges of said first and second main walls comprise a curved portion conforming to said curvature of said curved corners of said end walls and each said main wall has a curved surface corresponding to said curved portions of said wall end edges of said main walls, wherein each said end wall comprises at least one end panel, and wherein at least one end tab extends from said first dispenser end edge of said dispenser box and is attached to an inner surface of said at least one end panel of said dispenser box thereby connecting said inner surface of said at least one end panel with said first dispenser end edge of said dispenser box.

* * * * *